US009394094B2

(12) United States Patent
Holley, Jr. et al.

(10) Patent No.: US 9,394,094 B2
(45) Date of Patent: Jul. 19, 2016

(54) CARTON WITH ARTICLE PROTECTION FEATURES

(71) Applicant: Graphic Packaging International, Inc., Atlanta, GA (US)

(72) Inventors: John Murdick Holley, Jr., Lawrenceville, GA (US); Colin P. Ford, Woodstock, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/633,459

(22) Filed: Feb. 27, 2015

(65) Prior Publication Data

US 2015/0246761 A1 Sep. 3, 2015

Related U.S. Application Data

(60) Provisional application No. 61/966,736, filed on Feb. 28, 2014.

(51) Int. Cl.
*B65D 71/38* (2006.01)
*B65D 71/36* (2006.01)

(52) U.S. Cl.
CPC ..... *B65D 71/36* (2013.01); *B65D 2571/0032* (2013.01); *B65D 2571/0045* (2013.01); *B65D 2571/0053* (2013.01);
(Continued)

(58) Field of Classification Search
CPC ..... B65D 71/38; B65D 5/32; B65D 5/445; B65D 5/4608; B65B 5/028; B65B 5/02
USPC ..... 206/433, 434, 427, 784, 594; 229/117.16; 53/456
See application file for complete search history.

(56) References Cited

U.S. PATENT DOCUMENTS 1,925,102 A 9/1933 Levkoff
2,005,924 A 6/1935 Wilson
(Continued)

FOREIGN PATENT DOCUMENTS

CA 873185 6/1971
CA 2 610 666 5/2008
(Continued)

OTHER PUBLICATIONS

International Search Report and Written Opinion for PCT/US2015/017959 dated Jun. 16, 2015.
(Continued)

*Primary Examiner* — Steven A. Reynolds
(74) *Attorney, Agent, or Firm* — Womble Carlyle Sandridge & Rice, LLP

(57) ABSTRACT

A carton for holding a plurality of containers. The carton can include a plurality of panels extending at least partially around an interior of the carton, the plurality of panels including a top panel, and an insert including a central panel, an inner end flap foldably connected to the central panel, and at least one crown guard flap foldably connected to the inner end flap adjacent a crown guard relief in the insert. The crown guard flap can be connected to at least a portion of the central panel by a collapsing nick. The top panel can at least partially overlap the central panel, and the crown guard flap can be positioned for contact with at least one container of the plurality of containers with the collapsing nick being at least partially folded.

47 Claims, 8 Drawing Sheets

(52) U.S. Cl.
CPC ..... *B65D 2571/00141* (2013.01); *B65D 2571/00574* (2013.01); *B65D 2571/00592* (2013.01); *B65D 2571/00666* (2013.01); *B65D 2571/00728* (2013.01); *B65D 2571/00814* (2013.01)

(56) References Cited

U.S. PATENT DOCUMENTS

| | | | |
|---|---|---|---|
| 2,067,749 | A | 1/1937 | Zimmerman et al. |
| 2,115,673 | A | 4/1938 | Stompe |
| 2,196,502 | A | 4/1940 | Kells |
| 2,299,027 | A | 10/1942 | Novak |
| 2,386,905 | A | 10/1945 | Meitzen |
| 2,648,484 | A | 8/1953 | Belsinger |
| 2,669,351 | A | 2/1954 | Carson et al. |
| 2,754,047 | A | 7/1956 | Schmidt et al. |
| 3,078,032 | A | 2/1963 | Robinson et al. |
| 3,128,010 | A | 4/1964 | Forrer |
| 3,133,634 | A | 5/1964 | Bozdar |
| 3,173,596 | A | 3/1965 | Aust et al. |
| 3,178,242 | A | 4/1965 | Ellis et al. |
| 3,228,582 | A | 1/1966 | Osberg |
| 3,263,861 | A | 8/1966 | Carr |
| 3,265,283 | A | 8/1966 | Farquhar |
| 3,300,115 | A | 1/1967 | Schauer |
| 3,332,594 | A | 7/1967 | De Capua |
| 3,346,167 | A | 10/1967 | Schmidt |
| 3,356,279 | A | 12/1967 | Root |
| 3,517,858 | A | 6/1970 | Farquhar |
| 3,533,549 | A | 10/1970 | Gilchrist |
| 3,540,581 | A | 11/1970 | Koolnis |
| 3,825,170 | A | 7/1974 | Aust et al. |
| 3,904,036 | A | 9/1975 | Forrer |
| 4,155,449 | A | 5/1979 | Bryne |
| 4,214,660 | A | 7/1980 | Hunt, Jr. |
| 4,222,485 | A | 9/1980 | Focke |
| 4,256,226 | A | 3/1981 | Stone |
| 4,318,474 | A | 3/1982 | Hasegawa |
| 4,364,509 | A | 12/1982 | Holley, Jr. et al. |
| 4,375,258 | A | 3/1983 | Crayne et al. |
| 4,376,509 | A | 3/1983 | Schaffer |
| 4,378,877 | A | 4/1983 | Botterman et al. |
| 4,396,143 | A | 8/1983 | Killy |
| 4,417,655 | A | 11/1983 | Forbes, Jr. |
| 4,417,661 | A | 11/1983 | Roccaforte |
| 4,538,759 | A | 9/1985 | Dutcher |
| 4,577,762 | A | 3/1986 | Kuchenbecker |
| 4,588,084 | A | 5/1986 | Holley, Jr. |
| 4,605,128 | A | 8/1986 | Rieke |
| 4,621,766 | A | 11/1986 | McClure |
| 4,658,984 | A | 4/1987 | Brunner |
| 4,757,938 | A | 7/1988 | Collins |
| 4,817,866 | A | 4/1989 | Wonnacott |
| 4,830,267 | A | 5/1989 | Wilson |
| 4,890,440 | A | 1/1990 | Romagnoli |
| 4,949,845 | A | 8/1990 | Dixon |
| 4,967,901 | A | 11/1990 | Wood |
| 4,974,771 | A | 12/1990 | Lavery |
| 5,072,876 | A | 12/1991 | Wilson |
| 5,101,642 | A | 4/1992 | Alexandrov |
| 5,119,985 | A | 6/1992 | Dawson et al. |
| 5,137,211 | A | 8/1992 | Summer et al. |
| 5,219,229 | A | 6/1993 | Sengewald |
| 5,249,681 | A | 10/1993 | Miller |
| 5,261,594 | A | 11/1993 | Brown et al. |
| 5,297,725 | A | 3/1994 | Sutherland |
| 5,320,277 | A | 6/1994 | Stout et al. |
| 5,333,734 | A | 8/1994 | Stout et al. |
| 5,350,109 | A | 9/1994 | Brown et al. |
| 5,425,474 | A | 6/1995 | Dalea et al. |
| 5,482,185 | A | 1/1996 | McNaughton |
| 5,482,203 | A | 1/1996 | Stout |
| 5,505,372 | A | 4/1996 | Edson et al. |
| 5,577,612 | A | 11/1996 | Chesson et al. |
| 5,588,585 | A | 12/1996 | McClure |
| 5,597,114 | A | 1/1997 | Kramedjian et al. |
| 5,622,309 | A | 4/1997 | Matsuda et al. |
| 5,664,683 | A | 9/1997 | Brody |
| 5,690,213 | A | 11/1997 | Matsumura |
| 5,690,230 | A | 11/1997 | Griffith |
| 5,794,778 | A | 8/1998 | Harris |
| 5,826,783 | A | 10/1998 | Stout |
| 5,873,516 | A | 2/1999 | Boggs |
| 5,875,961 | A | 3/1999 | Stone et al. |
| 5,881,884 | A | 3/1999 | Podosek |
| 5,921,398 | A | 7/1999 | Carroll |
| 5,924,559 | A | 7/1999 | Carrel et al. |
| 5,927,498 | A | 7/1999 | Saam |
| 6,050,402 | A | 4/2000 | Walter |
| 6,149,009 | A | 11/2000 | Denola |
| 6,170,741 | B1 | 1/2001 | Skolik et al. |
| 6,176,419 | B1 | 1/2001 | Holley, Jr. |
| 6,250,542 | B1 | 6/2001 | Negelen |
| 6,283,293 | B1 | 9/2001 | Lingamfelter |
| 6,302,320 | B1 | 10/2001 | Stout |
| 6,409,077 | B1 | 6/2002 | Telesca et al. |
| D459,927 | S | 7/2002 | Flowers et al. |
| 6,471,120 | B1 | 10/2002 | Vogel |
| 6,478,219 | B1 | 11/2002 | Holley, Jr. |
| 6,484,903 | B2 | 11/2002 | Spivey et al. |
| 6,550,615 | B2 | 4/2003 | Lingamfelter |
| 6,557,699 | B1 | 5/2003 | Focke et al. |
| 6,578,736 | B2 | 6/2003 | Spivey |
| 6,604,677 | B1 | 8/2003 | Sutherland et al. |
| 6,631,803 | B2 | 10/2003 | Rhodes et al. |
| 6,669,083 | B2 | 12/2003 | Bates |
| 6,715,639 | B2 | 4/2004 | Spivey |
| 6,752,262 | B1 | 6/2004 | Boriani et al. |
| 6,766,940 | B2 | 7/2004 | Negelen |
| 6,789,673 | B2 | 9/2004 | Lingamfelter |
| 6,848,573 | B2 | 2/2005 | Gould et al. |
| 6,866,186 | B2 | 3/2005 | Fogle et al. |
| 6,902,104 | B2 | 6/2005 | Holley, Jr. et al. |
| 6,905,066 | B2 | 6/2005 | Holley, Jr. |
| 6,918,487 | B2 | 7/2005 | Harrelson |
| 6,926,193 | B2 | 8/2005 | Smalley |
| 6,929,172 | B2 | 8/2005 | Bates et al. |
| 6,932,265 | B2 | 8/2005 | Sax et al. |
| 6,968,992 | B2 | 11/2005 | Schuster |
| 6,969,172 | B2 | 11/2005 | Actis-Datta |
| 6,974,072 | B2 | 12/2005 | Harrelson |
| 6,991,107 | B2 | 1/2006 | Harrelson |
| 6,997,316 | B2 | 2/2006 | Sutherland |
| 7,000,803 | B2 | 2/2006 | Miller |
| 7,073,665 | B2 | 7/2006 | Auclair et al. |
| 7,104,435 | B2 | 9/2006 | Holley, Jr. |
| 7,134,593 | B2 | 11/2006 | Harrelson |
| 7,159,759 | B2 | 1/2007 | Sutherland et al. |
| 7,225,930 | B2 | 6/2007 | Ford et al. |
| 7,422,104 | B2 | 9/2008 | Perkinson |
| 7,478,743 | B2 | 1/2009 | Holley, Jr. |
| 7,604,157 | B2 | 10/2009 | Zammit et al. |
| 7,699,163 | B2 | 4/2010 | Gomes et al. |
| 7,699,215 | B2 | 4/2010 | Spivey, Sr. |
| 8,356,743 | B2 | 1/2013 | Spivey, Sr. |
| 8,387,855 | B2 | 3/2013 | Brand |
| 8,439,194 | B2 | 5/2013 | Spivey |
| 8,453,919 | B2 | 6/2013 | Eckermann |
| 8,496,109 | B2 | 7/2013 | Smalley et al. |
| 8,919,557 | B2 | 12/2014 | Spivey, Sr. |
| 8,967,380 | B2 | 3/2015 | Moncrief et al. |
| 2001/0017315 | A1 | 8/2001 | Baroudi |
| 2002/0029991 | A1 | 3/2002 | Lingamfelter |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185499 | A1 | 12/2002 | Harrelson et al. |
| 2003/0006158 | A1 | 1/2003 | Skolik et al. |
| 2003/0136820 | A1 | 7/2003 | Negelen |
| 2003/0141313 | A1 | 7/2003 | Bates |
| 2003/0150759 | A1 | 8/2003 | White, Jr. |
| 2003/0192907 | A1 | 10/2003 | Bates |
| 2004/0040334 | A1 | 3/2004 | Rusnock |
| 2004/0060972 | A1 | 4/2004 | Harrelson |

(56) References Cited

U.S. PATENT DOCUMENTS

| | | | |
|---|---|---|---|
| 2004/0089575 | A1 | 5/2004 | Lingamfelter |
| 2004/0089671 | A1 | 5/2004 | Miller |
| 2004/0099558 | A1 | 5/2004 | Oliff et al. |
| 2004/0155098 | A1 | 8/2004 | Harrelson |
| 2004/0188277 | A1 | 9/2004 | Auclair |
| 2004/0188300 | A1 | 9/2004 | Sutherland |
| 2004/0188508 | A1 | 9/2004 | Holley, Jr. et al. |
| 2005/0023170 | A1 | 2/2005 | Lingamfelter |
| 2005/0092820 | A1 | 5/2005 | Chekroune |
| 2005/0115843 | A1 | 6/2005 | Harrelson |
| 2005/0126947 | A1 | 6/2005 | Holley, Jr. |
| 2005/0167291 | A1 | 8/2005 | Sutherland |
| 2005/0167478 | A1 | 8/2005 | Holley, Jr. |
| 2005/0189405 | A1 | 9/2005 | Gomes et al. |
| 2005/0263574 | A1 | 12/2005 | Schuster |
| 2006/0054522 | A1 | 3/2006 | Kline et al. |
| 2006/0081691 | A1 | 4/2006 | Smalley |
| 2006/0091193 | A1 | 5/2006 | DeBusk |
| 2006/0118606 | A1 | 6/2006 | Holley, Jr. et al. |
| 2006/0131370 | A1 | 6/2006 | Bates |
| 2006/0175386 | A1 | 8/2006 | Holley, Jr. |
| 2006/0231441 | A1 | 10/2006 | Gomes |
| 2006/0231600 | A1 | 10/2006 | Holley, Jr. |
| 2006/0249413 | A1 | 11/2006 | Auclair et al. |
| 2006/0278689 | A1 | 12/2006 | Boshinski et al. |
| 2007/0007325 | A1 | 1/2007 | Suzuki et al. |
| 2007/0029371 | A1 | 2/2007 | Theelen |
| 2007/0108261 | A1 | 5/2007 | Schuster |
| 2007/0131748 | A1 | 6/2007 | Brand |
| 2007/0164093 | A1 | 7/2007 | Spivey et al. |
| 2007/0181658 | A1 | 8/2007 | Sutherland |
| 2007/0205255 | A1 | 9/2007 | Dunn |
| 2007/0210144 | A1 | 9/2007 | Brand |
| 2007/0251982 | A1 | 11/2007 | Brand |
| 2007/0295790 | A1 | 12/2007 | Zammit et al. |
| 2008/0023535 | A1 | 1/2008 | Holley, Jr. |
| 2008/0048014 | A1 | 2/2008 | Bates |
| 2008/0128479 | A1 | 6/2008 | Bates et al. |
| 2008/0257944 | A1 | 10/2008 | Blin |
| 2009/0282843 | A1 | 11/2009 | Brand |
| 2010/0044420 | A1 | 2/2010 | Brand et al. |
| 2010/0122999 | A1 | 5/2010 | Brand |
| 2010/0237138 | A1 | 9/2010 | Bradford |
| 2011/0011924 | A1 | 1/2011 | Spivey et al. |
| 2011/0049228 | A1 | 3/2011 | Brand |
| 2011/0068160 | A1 | 3/2011 | Brand et al. |
| 2011/0290692 | A1* | 12/2011 | Spivey, Sr. ..... B65D 71/36 206/433 |
| 2012/0091021 | A1 | 4/2012 | Smalley |
| 2013/0118942 | A1 | 5/2013 | Smalley et al. |
| 2013/0119122 | A1 | 5/2013 | Spivey, Sr. |
| 2013/0277260 | A1 | 10/2013 | Smalley et al. |
| 2013/0284628 | A1 | 10/2013 | Moncrief et al. |

FOREIGN PATENT DOCUMENTS

| | | |
|---|---|---|
| EP | 0 066 029 | 12/1982 |
| EP | 1 433 714 | 6/2004 |
| EP | 1 698 565 | 9/2006 |
| FR | 2 549 010 | 1/1985 |
| GB | 2 264 101 | 8/1993 |
| JP | 2002-128064 | 5/2002 |
| JP | 2005-255224 A | 9/2005 |
| JP | 2006-111342 | 4/2006 |
| JP | 2007-055630 | 3/2007 |
| JP | 2007-532421 | 11/2007 |
| JP | 2010-149927 | 7/2010 |
| KR | 10-0154124 | 2/1999 |
| KR | 10-0371048 | 8/2003 |
| WO | WO 96/21603 | 7/1996 |
| WO | WO 96/29260 | 9/1996 |
| WO | WO 99/28198 | 6/1999 |
| WO | WO 99/64301 | 12/1999 |
| WO | WO 00/03937 | 1/2000 |
| WO | WO 02/47990 | 6/2002 |
| WO | WO 2004/043790 | 5/2004 |
| WO | WO 2005/051781 | 6/2005 |
| WO | WO 2005/100175 | 10/2005 |
| WO | WO 2006/050210 | 5/2006 |
| WO | WO 2006/050316 | 5/2006 |
| WO | WO 2007/076544 | 7/2007 |

OTHER PUBLICATIONS

International Search Report and Written Opinion for PCT/US2014/037640 dated Sep. 12, 2014.

International Search Report and Written Opinion for PCT/US2014/037655 dated Sep. 4, 2014.

International Search Report and Written Opinion for PCT/US2014/037656 dated Sep. 4, 2014.

International Search Report and Written Opinion for PCT/US2014/069472 dated Apr. 1, 2015.

* cited by examiner

CARTON WITH ARTICLE PROTECTION FEATURES

CROSS REFERENCE TO RELATED APPLICATIONS

This application claims the benefit of U.S. Provisional Patent Application No. 61/966,736, filed Feb. 28, 2014.

INCORPORATION BY REFERENCE

The disclosures of U.S. Provisional Patent Application No. 61/855,323, which was filed on May 13, 2013, U.S. Provisional Patent Application No. 61/855,305, which was filed on May 13, 2013, U.S. Provisional Patent Application No. 61/959,162, which was filed on Aug. 16, 2013, U.S. Provisional Patent Application No. 61/963,653, which was filed on Dec. 10, 2013, U.S. Provisional Patent Application No. 61/966,736, which was filed on Feb. 28, 2014, U.S. patent application Ser. No. 14/274,975, which was filed on May 12, 2014, U.S. patent application Ser. No. 14/275,143, which was filed on May 12, 2014, U.S. patent application Ser. No. 14/565,788, which was filed on Dec. 10, 2014, U.S. patent application Ser. No. 13/419,740, which was filed on Mar. 14, 2012, U.S. patent application Ser. No. 13/768,079, which was filed on Feb. 15, 2013, and U.S. patent application Ser. No. 13/833,542, which was filed on Mar. 15, 2013, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons and/or inserts for cartons having article protection features.

SUMMARY OF THE DISCLOSURE

In another aspect, the disclosure is directed to a carton for holding a plurality of containers. The carton can comprise a plurality of panels extending at least partially around an interior of the carton, the plurality of panels comprising a top panel, and an insert comprising a central panel, an inner end flap foldably connected to the central panel, and at least one crown guard flap foldably connected to the inner end flap adjacent a crown guard relief in the insert. The crown guard flap can be connected to at least a portion of the central panel by a collapsing nick. The top panel can at least partially overlap the central panel, and the crown guard flap can be positioned for contact with at least one container of the plurality of containers with the collapsing nick being at least partially folded.

In another aspect, the disclosure is generally directed to, in combination, a carton blank and an insert blank for forming a carton for holding a plurality of containers. The carton blank can comprise a plurality of panels comprising a top panel. The insert blank can comprise a central panel, an inner end flap foldably connected to the central panel, and at least one crown guard flap foldably connected to the inner end flap adjacent a crown guard relief in the insert. The crown guard flap can be connected to at least a portion of the central panel by a collapsing nick. The top panel can at least partially overlap the central panel, and the crown guard flap can be for being positioned to contact at least one container of the plurality of containers with the collapsing nick being at least partially folded when the carton is formed from the blank.

In another aspect, the disclosure is generally directed to a method of forming an insert with crown guard flaps. The method can comprise obtaining a carton blank comprising a plurality of panels comprising a top panel, obtaining an insert blank comprising a central panel, an inner end flap foldably connected to the central panel, and at least one crown guard flap foldably connected to the inner end flap adjacent a crown guard relief in the insert. The crown guard flap can be connected to at least a portion of the central panel by a collapsing nick. The method further can comprise positioning the insert blank relative to the carton blank so that the top panel at least partially overlaps the central panel and forming an interior of the carton at least partially defined by the plurality of panels. The forming the interior of the carton can comprise forming an open-ended sleeve. The method also can comprise forming a crown retention feature in the interior of the carton comprising folding the inner end flap over an end of the open-ended sleeve. The folding the inner end flap can cause at least a portion of the crown guard flap to fold with respect to the inner end flap for contacting at least one container of the plurality of containers. The folding of the crown guard flap can cause the collapsing nick to be at least partially folded.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "interior," "outer," "exterior," "lower," "bottom," "upper," and "top" indicate orientations determined in relation to fully erected and upright cartons.

Figure 1:
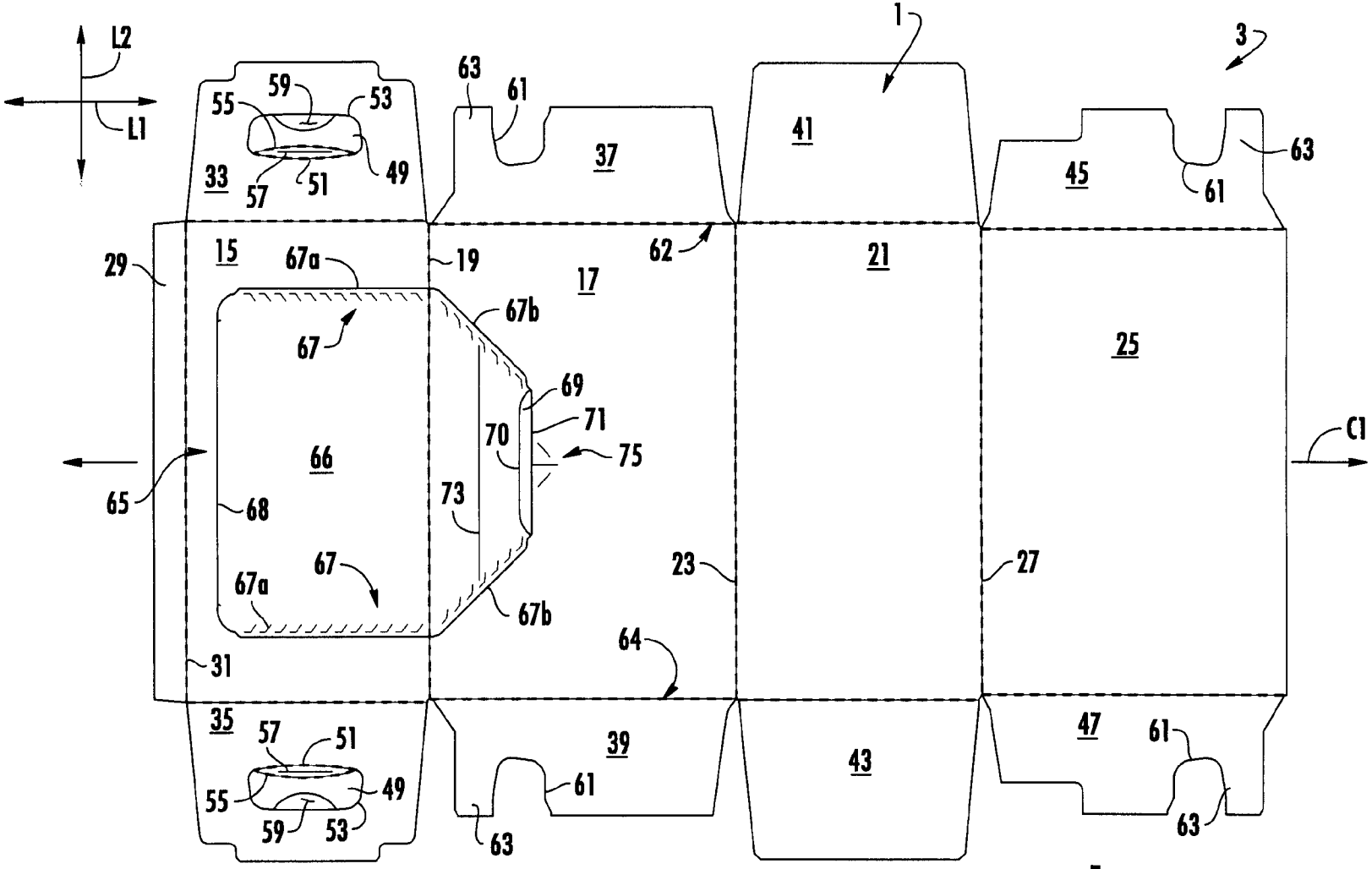
FIG. 1 is a plan view of an interior surface of a blank for forming a carton according to an exemplary embodiment of the disclosure.
Figure 5:
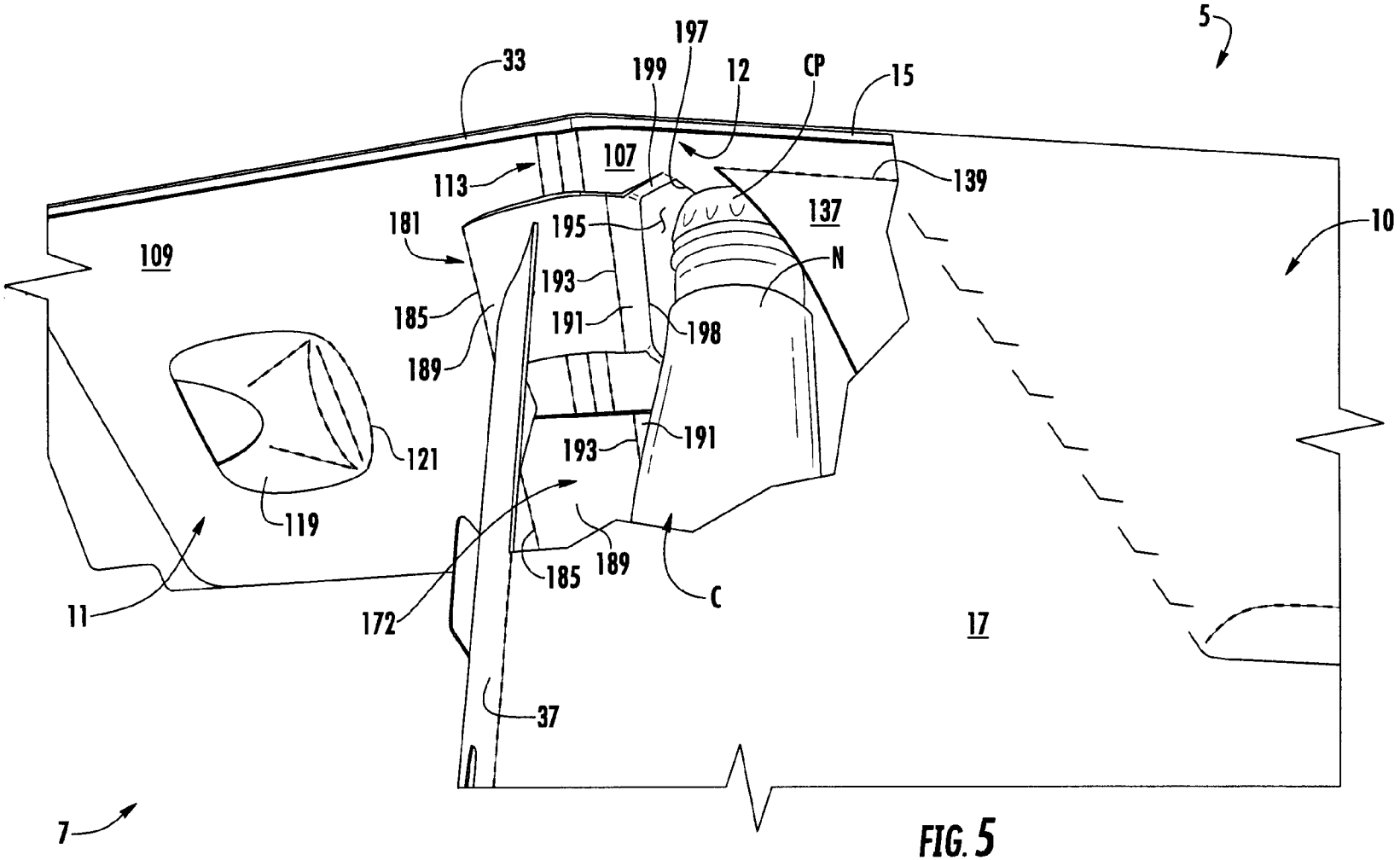
FIGS. 5 and 6 are perspective side views of a partially broken-away, partially assembled carton showing a portion of the insert while an end of the partially assembled carton is closed according to the exemplary embodiment of the disclosure.
Figure 6:
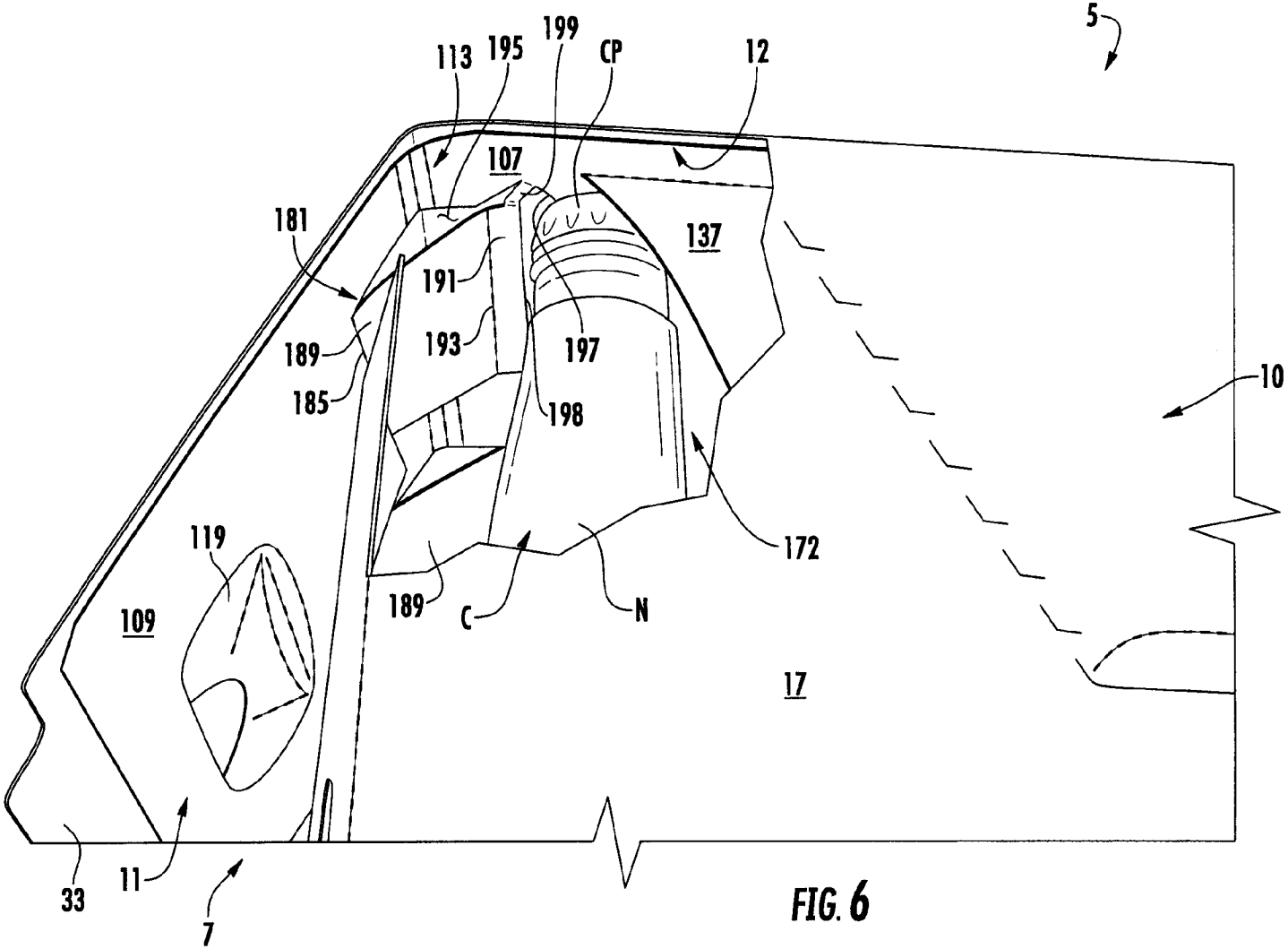
Figure 7:
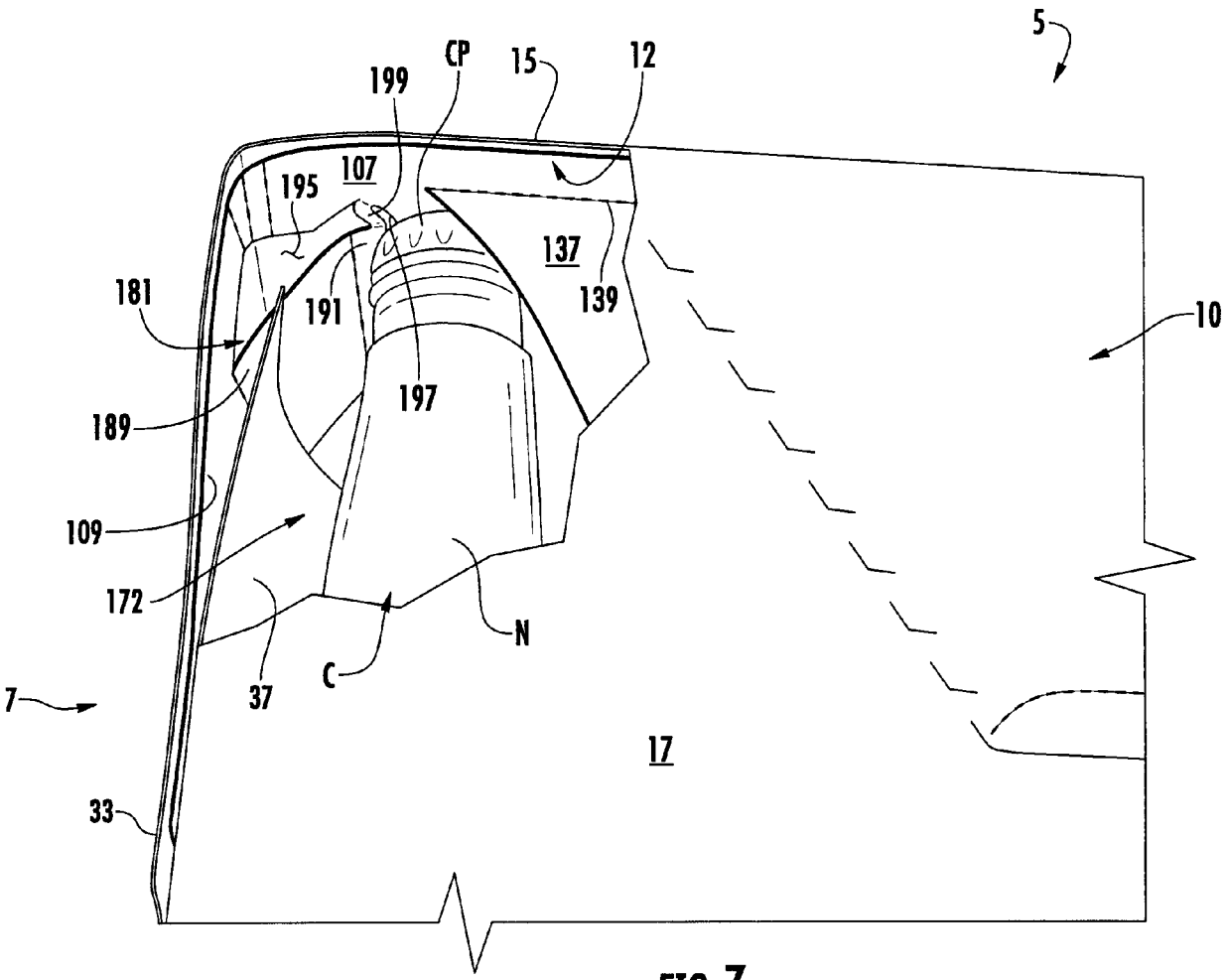
FIG. 7 is a perspective side view of a partially broken-away carton having a closed end showing a portion of the insert of FIGS. 5 and 6 in the interior of the carton.

FIG. 1 is a plan view of the interior side 1 of a blank, generally indicated at 3, used to form a carton 5 (FIG. 8) according to an exemplary embodiment of the disclosure. The carton 5 can be used to house a plurality of articles such as containers C with necks or upper portions N that are generally narrower than the lower portions of the containers (FIG. 5-7). The containers C can include tops or caps CP (FIG. 5-7). In the illustrated embodiment, the carton 5 is sized to house twenty containers C in a single layer in a 4×5 arrangement, but it is understood that the carton 5 may be sized and shaped to hold containers of a different or same quantity in more than one layer and/or in different row/column arrangements (e.g., 1×6, 3×4, 2×6×2, 3×5, 3×6, 2×9, 2×6, 4×4, etc.). The carton 5 can include a dispenser 10 (FIG. 8) for allowing access to the containers C. In the illustrated embodiment, the carton 5 includes first and second handles 11 (FIG. 8) for grasping and carrying the carton at a respective first end 7 and second end 9 of the carton. As will be discussed below in more detail, the handles 11, are formed from various features in the blank 3. The carton 5 includes an insert 12 (FIGS. 5-7) that reinforces and strengthens the handles 11 and includes crown guard features (e.g., a crown retention panel, an inner side flap, and crown guard flaps) that reinforce and stabilize the containers C in the carton.

The blank 3 and carton 5 can have features that are similar or identical to the features described in any of the embodiments disclosed in the above-noted incorporated by reference patent applications, including U.S. patent application Ser. No. 13/419,740, and all related applications. Accordingly, in one embodiment, the carton 5 may have article protection flaps (not shown) for protecting the at least one article. As noted in the incorporated by reference applications, the article protection flaps are moveable between a first position and a second position placed between adjacent containers C in the carton to reduce movement of the containers in the carton and prevent breakage of the containers. The carton 5 can have other features (e.g., article protection features in the ends 7, 9 of the carton 5 for cushioning one or more of the containers C) without departing from the disclosure.

The carton blank 3 has a longitudinal axis L1 and a lateral axis L2. The carton blank 3 can include a longitudinal centerline C1, as shown in FIG. 1. In the illustrated embodiment, the blank 3 comprises a top panel 15 foldably connected to a first side panel 17 at a first lateral fold line 19. A bottom panel 21 is foldably connected to the first side panel 17 at a second lateral fold line 23. A second side panel 25 is foldably connected to the bottom panel 21 at a third lateral fold line 27. In the illustrated embodiment, the blank 3 includes an attachment flap 29 foldably connected to the top panel 15 at a fourth lateral fold line 31. Any of the top and bottom panels 15, 21, the first and second side panels 17, 25, and the attachment flap 29 can be otherwise shaped, arranged, configured, or omitted, without departing from the disclosure. For example, the blank 3 can alternatively include two top panels cooperating to form a top of the carton 5 or two bottom panels cooperating to form a bottom of the carton. Additionally, the attachment flap 29 could be foldably connected to the second side panel 25 in an alternative embodiment.

The top panel 15 is foldably connected to a first top end flap 33 and a second top end flap 35. The first side panel 17 is foldably connected to a first side end flap 37 and a second side end flap 39. The bottom panel 21 is foldably connected to a first bottom end flap 41 and a second bottom end flap 43. The second side panel 25 is foldably connected to a first side end flap 45 and a second side end flap 47. When the carton 5 is erected, the top and bottom end flaps 33 and 41 and side end flaps 37 and 45 close the first end 7 of the carton, and the top and bottom end flaps 35 and 43 and side end flaps 39 and 47 close the second end 9 of the carton. In accordance with an alternative embodiment of the present disclosure, different flap arrangements can be used for at least partially closing the ends 7, 9 of the carton 5.

In one embodiment, the top and bottom end flaps 33 and 41 and side end flaps 37 and 45 extend along a first marginal area of the blank 3, and are foldably connected at a first longitudinal fold line 62 that extends along the length of the blank. In the illustrated embodiment, the top and bottom end flaps 35 and 43 and side end flaps 39 and 47 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

As shown in FIG. 1, the features that form the handles 11 of the carton 5 include elongate handle flaps 49 formed in respective top end flaps 33, 35 and foldably attached to the respective top end flap at a respective arcuate fold line 51. The handle flaps 49 are separable from the respective top end flaps 33, 35 along a respective cut or tear line 53. An opposing arcuate fold line 55 can extend in each of the handle flaps 49 adjacent or proximate the respective arcuate fold lines 51, and a longitudinal score 57 can extend between the opposing arcuate fold lines 51, 55 in each of the handle flaps. In one embodiment, each of the handle flaps 49 can have an edge (e.g., a curved edge) that is adjacent a cutout 59. The features that form the handles 11 further include cutouts 61 in the respective side end flaps 37, 45, 39, 47. The side end flaps 37, 45, 39, 47 can also include respective upper portions 63 disposed above the respective cutouts 61. One of the handles 11 could have different features than the other handle or could be omitted without departing from the disclosure. One or both of the handles 11 could be otherwise shaped, arranged, positioned, and/or configured without departing from the disclosure. For example, one or both of the opposing arcuate fold lines 51, 55 in each handle 11 could be generally longitudinal.

According to the illustrated embodiment, the dispenser 10 comprises an outer dispenser pattern 65 including an outer dispenser panel 66, two outer tear lines 67, and a fold line 68 in the carton blank 3. The outer dispenser panel 66 is defined by the fold line 68 extending in the top panel 15 generally in the lateral L2 direction and the outer tear lines 67, which extend from the respective ends of the fold line 68 in the top panel 15 and into the first side panel 17. As shown in FIG. 1, each of the tear lines 67 can include a generally longitudinal portion 67*a* in at least the top panel 15 and an oblique portion 67*b* in at least the first side panel 17. In the illustrated embodiment, the outer dispenser pattern 65 can include an access panel 69 that is foldably connected to the outer dispenser panel 66 along a lateral fold line 70 and is separable from the outer dispenser panel 66 and the first side panel 17 along a tear or cut line 71. The outer dispenser panel 66 is separable from the top panel along the outer tear lines 67 to form a dispenser opening (not shown) to provide access to the containers C within the carton. The access panel 69 can help initiate tearing along the outer tear lines 67 by folding inwardly along the fold line 70 to form an access opening (not shown) capable of receiving a hand, fingers, etc. so that a user can grip the outer dispenser panel 66 adjacent the access panel 69 and pull the outer dispenser panel 66 outwardly from the carton 5. As shown in FIG. 1, the outer dispenser pattern 65 can also include a lateral score 73 and cuts 75 that can also help with actuating the outer dispenser panel 66. The outer dispenser pattern 65 could be omitted or could be otherwise shaped, arranged, positioned, and/or configured without departing from the disclosure.

In one embodiment, the bottom panel 21 can include any suitable number of symmetric or asymmetric article protection flaps (not shown) foldably connected to the bottom panel and arranged in one or more aligned or offset rows. The rows could be aligned with one another and/or one or more rows could be offset from other rows. The article protection flaps can have different orientations than one another. In one embodiment, the article protection flaps can be the same as or similar to those described in U.S. patent application Ser. No. 14/565,788, filed Dec. 10, 2014, the disclosure of which is hereby incorporated by reference for all purposes as if presented herein in its entirety. The article protection flaps could be omitted or could be otherwise shaped, arranged, positioned, and/or configured without departing from the disclosure. For example, the article protection flaps can be similar to, or the same as, those described in U.S. patent application Ser. No. 13/419,740, filed Mar. 14, 2012, the disclosure of which is hereby incorporated by reference for all purposes as if presented herein in its entirety.

Figure 2:
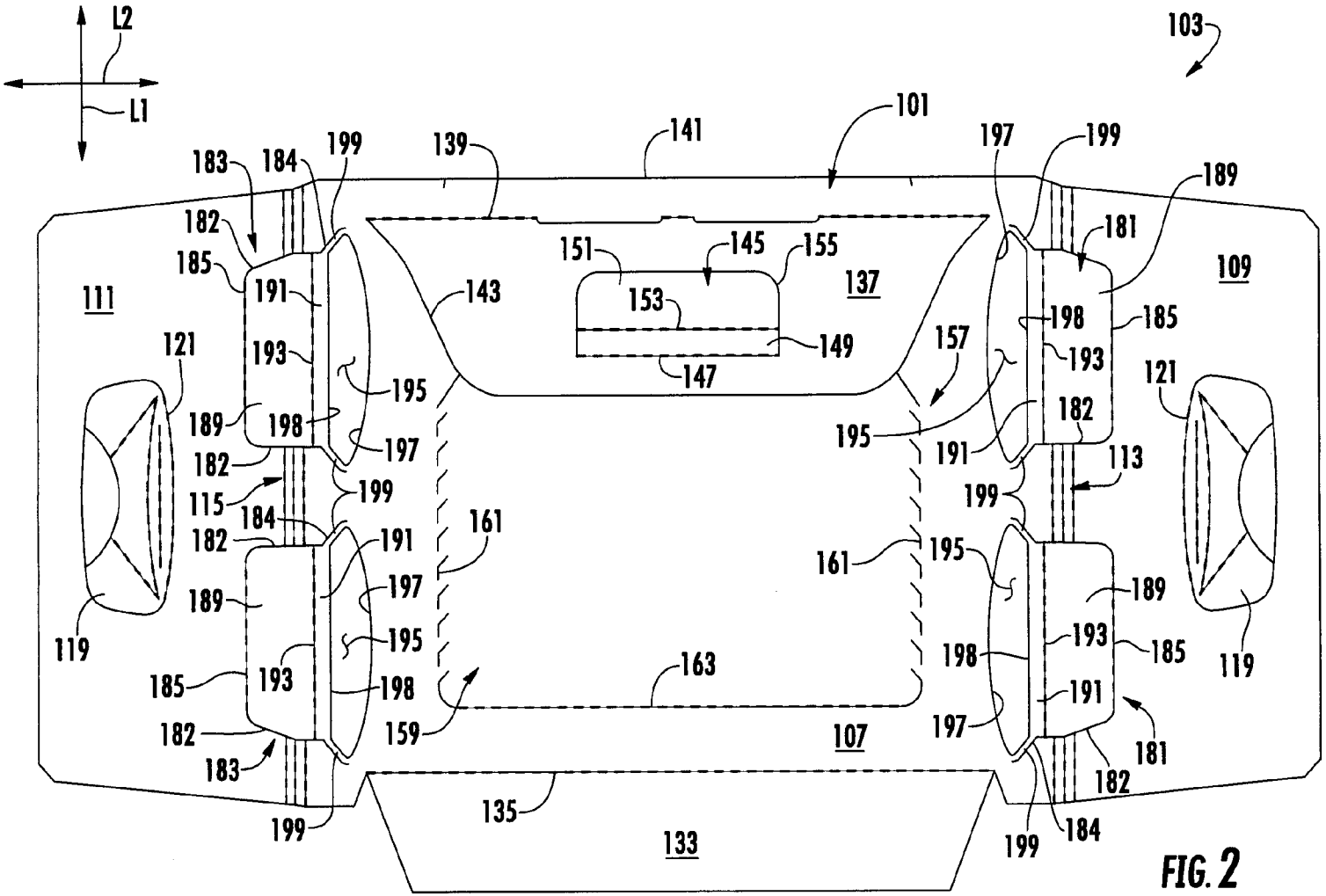
FIG. 2 is a plan view of an insert blank for forming an insert according to the exemplary embodiment of the disclosure.
Figure 4:
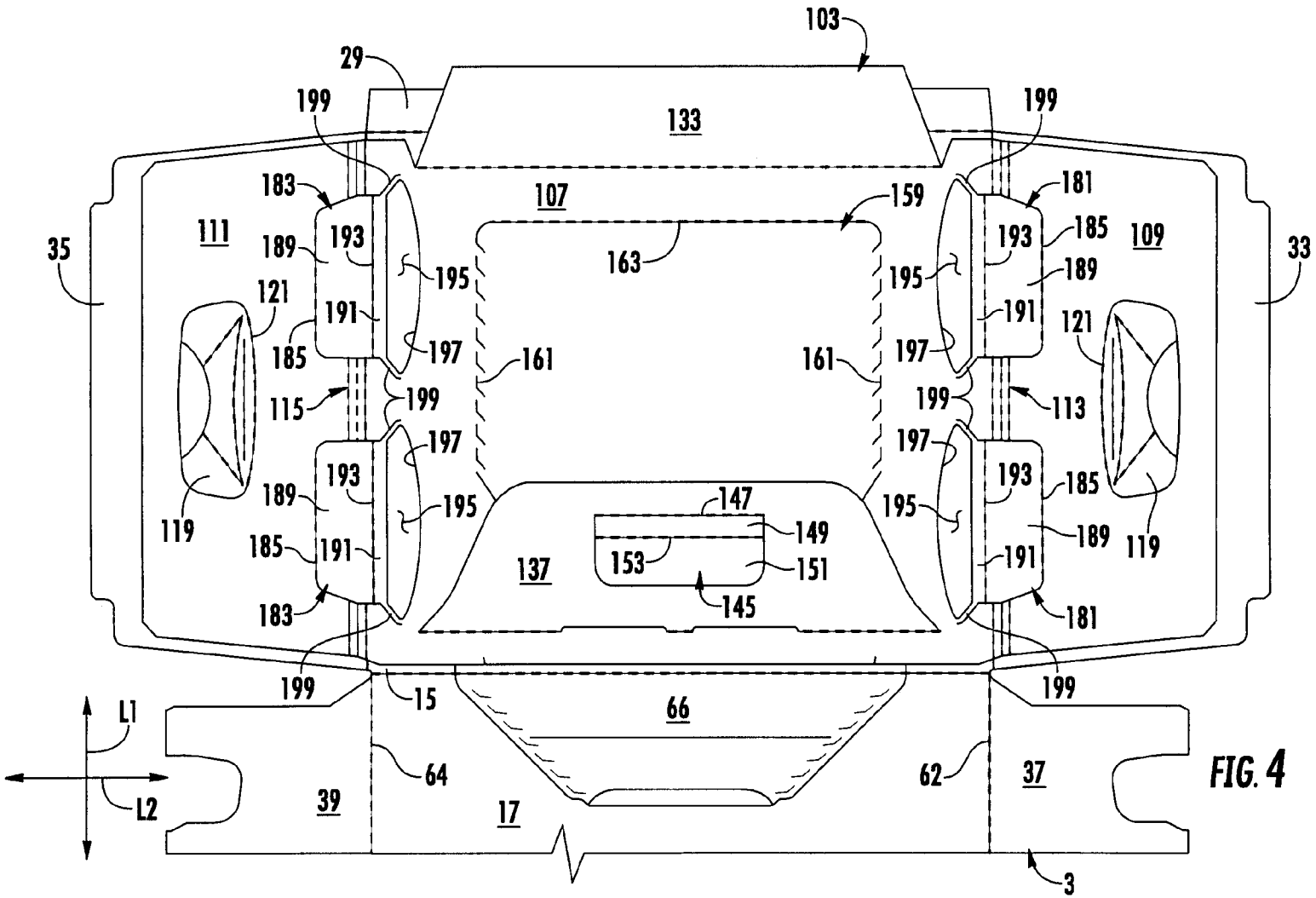
FIG. 4 is a plan view of the insert blank of FIG. 2 in combination with the carton blank of FIG. 1

FIG. 2 illustrates an exterior surface 101 of an insert blank 103 used to form the insert 12 (FIGS. 5-7) for use in the carton 5 according to the exemplary embodiment of the disclosure. As illustrated in FIGS. 2 and 4, the longitudinal axis L1 and the lateral axis L2 of the insert blank 103 are oriented so that the longitudinal axis L1 and the lateral axis L2 of the insert blank 103 comport with the respective longitudinal axis L1 and lateral axis L2 of the carton blank 3 established in FIG. 1. In the illustrated embodiment, the insert blank 103 includes a central panel 107 and two inner end flaps 109, 111 respectively foldably connected to the central panel 107 at opposite ends of the central panel. A first fold line or area 113 connects the first inner end flap 109 to the central panel 107 at the first end of the insert blank 103, and a second fold line or area 115 connects the second inner end flap 111 to the central panel 107 at the second end of the insert blank 103. In the illustrated embodiment, each of the fold areas 113, 115 can include several fold lines (e.g., scores, creases, cut-crease lines, etc.). Alternatively, the fold areas 113, 115 can be other lines or areas of weakening for folding the inner end panels 109, 111 relative to the central panel 107 (e.g., a single fold line).

In the illustrated embodiment, the insert blank 103 includes features for forming the handles 11 in the carton 5. Each of the inner end flaps 109, 111 can include an inner handle flap 119 foldably attached to the respective inner end flap at a respective arcuate fold line 121. The inner handle flaps 119 can be similar or identical to the respective outer handle flaps 49 so that the inner and outer handle flaps, fold lines, and cutouts are generally aligned and/or are overlapped with respect to one another in the handles 11 in the erected carton 5. The inner handle flaps 119 and/or the fold lines 121 could be otherwise shaped, arranged, positioned, and/or configured without departing from the disclosure.

In the illustrated embodiment, the insert blank 103 includes a side flap 133 foldably connected to the central panel 107 at a lateral fold line 135, which, as shown in FIG. 2, is offset from the outer edge of the insert blank 103. In one embodiment, an inner side panel or crown retention panel 137 can be included in the central panel 107. As shown in FIG. 2, the crown retention panel 137 is foldably connected to the central panel 107 along a lateral fold line 139 that is spaced apart from a free edge 141 of the reinforcing insert blank 103. The crown retention panel 137 can be separable from the central panel 107 along a tear or cut line 143. In the illustrated embodiment, the crown retention panel 137 includes an attachment flap 145 foldably connected to the crown retention panel 137 along a lateral fold line 147. The attachment flap 145 can include a proximal portion 149 foldably connected to a distal portion 151 along a lateral fold line 153 so that the proximal portion 149 can be independently positioned with respect to the distal portion 151. In one embodiment, the attachment flap 145 can be separable from the crown retention panel 137 along a tear or cut line 155 (e.g., a U-shaped cut line). The side flap 133, the crown retention panel 137, and/or the attachment flap 145 could be otherwise shaped, arranged, positioned, and/or configured without departing from the disclosure. For example, the crown retention panel 137 could include any suitable number of attachment flaps 145 (e.g., more than one attachment flap). Additionally, the attachment flap 145 and/or the crown retention panel 137 could be rotated with respect to the orientation shown in FIG. 2.

As shown in FIG. 2, the insert blank 103 can include an inner dispenser pattern 157 including an inner dispenser portion 159 at least partially defined by tear lines 161 and a fold line 163. The inner dispenser portion 159 is configured to be aligned with at least a portion of the outer dispenser panel 66 of the top panel 15 of the carton blank 3. In one embodiment, the inner dispenser panel 159 can include at least a portion of the crown retention panel 137. For example, the crown retention panel 137 can be pivoted upwardly with the dispenser panels 66, 159 when the dispenser 10 is actuated. The inner dispenser pattern 157 could be omitted or could be otherwise shaped, arranged, positioned, and/or configured without departing from the disclosure.

Figure 3:
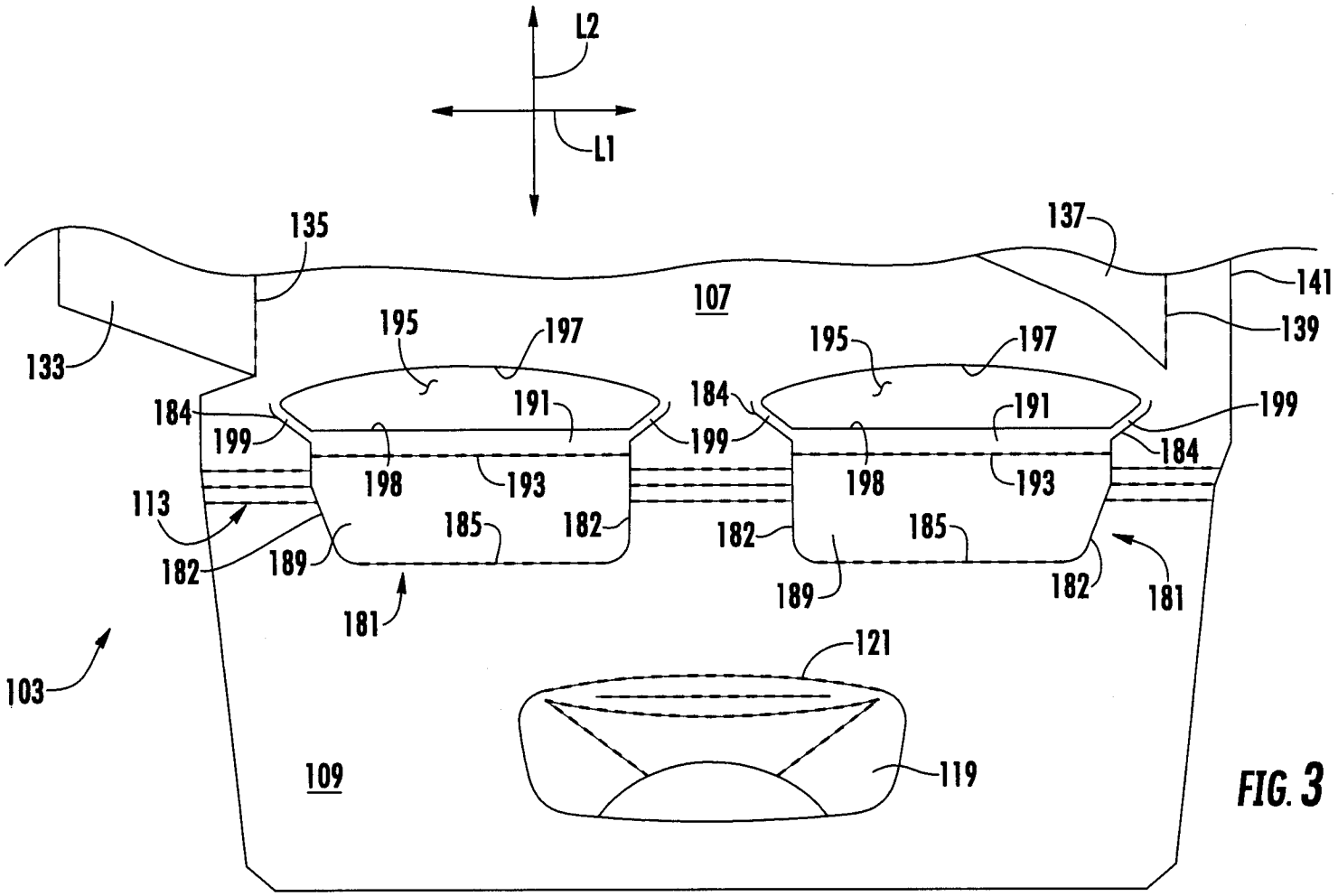
FIG. 3 is a detail plan view of a top end flap and crown guard flaps of the insert blank of FIG. 2 according to the exemplary embodiment of the disclosure.

As shown in FIGS. 2-4, the insert blank 103 includes two crown guard flaps 181 foldably connected to the first inner end flap 109 and two crown guard flaps 183 foldably connected to the second inner end flap 111. In one embodiment, each of the crown guard flaps 181, 183 can be at least partially separable from the respective inner end flaps 109, 111 and/or the central panel 107 along cut line 182. In the illustrated embodiment, each of the crown guard flaps 181, 183 includes a proximal or first portion 189 foldably connected to the respective inner end flap 109, 111 along a respective fold line 185 and a distal or second portion 191 foldably connected to the respective first portion 189 along a respective fold line 193. The crown guard flaps 181 can extend in a respective opening or crown guard relief 195 in the central panel 107 and the respective inner end flap 109, 111, interrupting the respective fold areas 113, 115. The central panel 107 can include a stop edge 197 extending along each of the crown guard reliefs 195, and the stop edges 197 can be sized and shaped to receive the respective second portions 191 of the respective crown guard flaps 181. Any of the inner end flaps 109, 111 and/or the crown guard flaps 181, 183 could be omitted or could be otherwise shaped, arranged, positioned, and/or configured without departing from the disclosure. For example, the fold line 193 could be omitted on one or more of the crown guard flaps 181, 183 so that the crown guard flap includes a single portion that is foldably connected to the inner end flap and that has a distal edge 198 adjacent the crown guard relief 195.

In the illustrated embodiment, each of the second portions 191 of the respective crown guard flaps 181, 183 can be connected to the central panel 107 by two collapsing nicks 199. In one embodiment, each of the collapsing nicks 199 can extend from or be continuous with the central panel 107 adjacent the stop edge 197 and can extend from or be continuous with the second portion 191 of the crown guard flap 181, 183. In one embodiment, the collapsing nicks 199 can be at least partially separable from the central panel 107 along respective cut lines 184, which can be generally continuous with the respective cut lines 182. Alternatively, one or more of the cut lines 184 could be replaced by an opening or other feature. The collapsing nicks 199 can help retain the crown guard flaps 181, 183 in the plane of the insert blank 103 until the ends of the carton 5 are closed during which the collapsing nicks 199 can bend, fold, buckle, or otherwise collapse or deform as the second portions 191 slide into engagement with the stop edges 197.

Any of the collapsing nicks could be omitted or could be otherwise shaped, arranged, positioned, and/or configured without departing from the disclosure. For example, the collapsing nicks 199 could be positioned at any suitable location along the respective crown guard relief 195, and the crown guard flaps 181, 183 could include any suitable number of collapsing nicks 199. In an alternative embodiment, one or all of the collapsing nicks 199 could be replaced by a small nick or other feature (e.g., a tear line) that could be cut, ripped, torn, etc. when the crown guard flaps 181, 183 are actuated in the crown reliefs 195.

As shown in FIGS. 4-6, in one exemplary embodiment, the carton 5 can be assembled by initially adhering the insert blank 103 to the top panel 15 and the top flaps 33, 35 of the carton blank 3. In the illustrated embodiment, as shown in FIG. 4, the insert blank 103 can be positioned on the interior surface of the carton blank 3 so that the central panel 107 is at least partially in face-to-face contact with the top panel 15 and the inner end flaps 109, 111 are at least partially in face-to-face contact with the respective top end flaps 33, 35 with the fold areas 113, 115 generally aligned with the respective longitudinal fold lines 62, 64. Additionally, the crown guard flaps 181, 183 can be overlapped by the top panel 15, the respective top end flaps 33, 35, and the respective fold lines 62, 64 (FIG. 4). The insert blank 103 could be otherwise positioned on the carton blank 3 without departing from the scope of this disclosure.

In the illustrated embodiment, the central panel 107 can be glued to the interior surface of the top panel 15, and the inner end flaps 109, 111 can be glued to the respective top end flaps 33, 35, such as by glue strips (not shown). In one embodiment, the crown retention panel 137 is not glued to the top panel 15, the side flap 133 is not glued to the top panel 15 or the attachment flap 29, and the crown guard flaps 181, 183 are not glued to the top panel 15 or the top end flaps 33, 35 so that the crown retention panel 137, the side flap 133, and the crown guard flaps 181, 183 can be positioned independently of the side panels, the attachment flap, and the top panel, and the top end flaps. In the illustrated embodiment, when the insert blank 103 is glued to the carton blank 3, the outer handle flaps 49 at least partially overlap and/or are generally aligned with the inner handle flaps 119.

In the illustrated embodiment, the carton blank 103 can be folded along the lateral fold lines 19 and 27 so that the first side panel 17 generally overlaps the top panel 15 and the central panel 107 and so that the second side panel 25 generally overlaps the attachment flap 29. The attachment flap 29 can be glued to the interior surface of the second side panel 25, such as by a glue strip (not shown). Similarly, the attachment flap 145 of the crown retention panel 137 can be glued to the first side panel 17, such as by a glue strip (not shown). In one embodiment, the attachment flaps 145 can be glued to the portion of the dispenser panel 66 that extends in the first side panel 17.

In accordance with the exemplary embodiment, the carton blank 3 with insert blank 103 can be further erected into the carton 5 by folding along fold lines 19, 23, 27, and 31 to form an open-ended sleeve (not shown) with an interior 172 (e.g., FIGS. 5-7). Containers C can be loaded into the interior 172 of the open-ended sleeve through an open end. In one embodiment, the containers C could be loaded before or after closing either or both of the ends 7, 9 of the carton. The sleeve could be otherwise formed without departing from the scope of this disclosure.

In the illustrated embodiment, as the open-ended sleeve is formed, the insert blank 103 is formed into the insert 12 (FIGS. 5-7). Accordingly, as the outer side panels 17, 25 are folded with respect to the top panel 15 (e.g., so that the side panels 17, 25 are generally vertical and the top panel 15 is generally horizontal), the crown retention panel 137 can at least partially separate from the central panel 107 to extend at least partially into the interior 172 of the open-ended sleeve, generally parallel to the first side panel 17 (FIGS. 5-7). In one embodiment, the attachment flap 145 separates from the crown retention flap 137 along the cut line 155 and remain attached to the first side panel 17 to help stabilize the lower portion of the crown retention panel 137. Additionally, the side flap 133 can fold along the lateral fold line 135, which is spaced apart from the second side panel 25. Accordingly, the side flap 133 can extend obliquely between the top panel 15 and the second side panel 25 in the interior 172 of the carton. In the illustrated embodiment, the crown retention panel 137 and the inner side flap 133 can contact the upper portions N and/or caps CP of the containers C that are adjacent the respective side panels 17, 25 to help restrain the narrower upper portions N of the containers. The crown retention panel 137 and the inner side flap 133 could be otherwise shaped, arranged, positioned, and/or configured without departing from the disclosure.

In the exemplary embodiment, the containers C can be inserted into the partially erected carton through an open end. For example, the collapsing nicks 199 can help retain the crown guard flaps 181, 183 in the plane of the central panel 107 and the inner end flaps 109, 111 as the containers C are inserted through the open ends 7, 9 of the carton. Accordingly, since the distal edges 198 of the crown guard flaps 181, 183 are directed toward the interior 172 of the partially erected carton, and the collapsing nicks 199 help retain the crown guard flaps 181, 183 against the top panel 15 when the top end flaps 33, 35 and the inner end flaps 109, 111 are upwardly folded (e.g., FIG. 5), it is less likely that the containers C will catch on the crown guard flaps 181, 183 as the containers are loaded through the open ends. The containers C could be loaded by alternative steps without departing from the disclosure.

As shown in FIGS. 5-7, wherein a portion of the side panel 17 is broken away to show the actuation of the crown guard flaps 181, 183, the end flaps 37, 41, 45 of the carton 5 are folded over the end 7 to close the end. The top end flap 33 and the inner end flap 109 can be downwardly folded over the end to overlap the side end flaps 37, 45 of the carton. In one embodiment, as the top end flap 33 and the inner end flap 109 are folded downwardly with respect to the top panel 15 and the central panel 107, the first portions 189 of the respective crown guard flaps 181 can separate from the top end flap 33 and the top panel 15, folding along the respective fold lines 185 so that the first portions 189 extend obliquely between the top end flap 33 and the top panel 15. The second portions 191 of the crown guard flaps 181 can fold along the respective fold lines 193 so that the second portions 191 can be generally in face-to-face contact with the top panel 15 and slide along the top panel 15 until the edges of the respective second portions 191 engage at least a portion of the respective stop edges 197 of the central panel 107 (FIG. 7) in one embodiment. As the second portions 191 of the crown guard flaps 181 slide toward the centerline of the central panel 107 in the crown guard relief 195, the collapsing nicks 199 can bend, fold, buckle, collapse, or otherwise deform to allow the second portions 191 move toward the respective stop edges 197. Accordingly, the collapsing nicks 199 can help retain the crown guard flaps 181, 183 in the plane of the central panel 107 out of the way of the containers C as the containers are loaded into the carton while allowing the second portions 191 of the crown guard flaps to translate relative to the central panel 107 without requiring the breaking of a nick or tearing of a tear line, for example, before closing the ends of the carton.

As shown in FIG. 7, the crown guard flaps 181 can engage the tops CP of the containers C adjacent the end 7 of the carton 5 (e.g., at or near the fold lines 193). In one embodiment, the first portions 189 of the crown guard flaps 181 extend obliquely between the top panel 15 and the end 7 and contact the sides of the tops CP of the containers C adjacent the end 7, and the second portions 191 of the crown guard flaps 181 are disposed between the tops CP of the containers C adjacent the end 7 and the top panel 15. Accordingly, the crown guard flaps 181 can help retain the containers C in the carton 5. The second end (not shown) of the carton 5 with the crown guard flap 183 can be closed in similar manner as the first end 7. The ends of the carton could be otherwise formed without departing from the scope of the disclosure. Additionally, the carton 5 and the insert 12 could be otherwise formed without departing from the scope of the disclosure.

Figure 8:
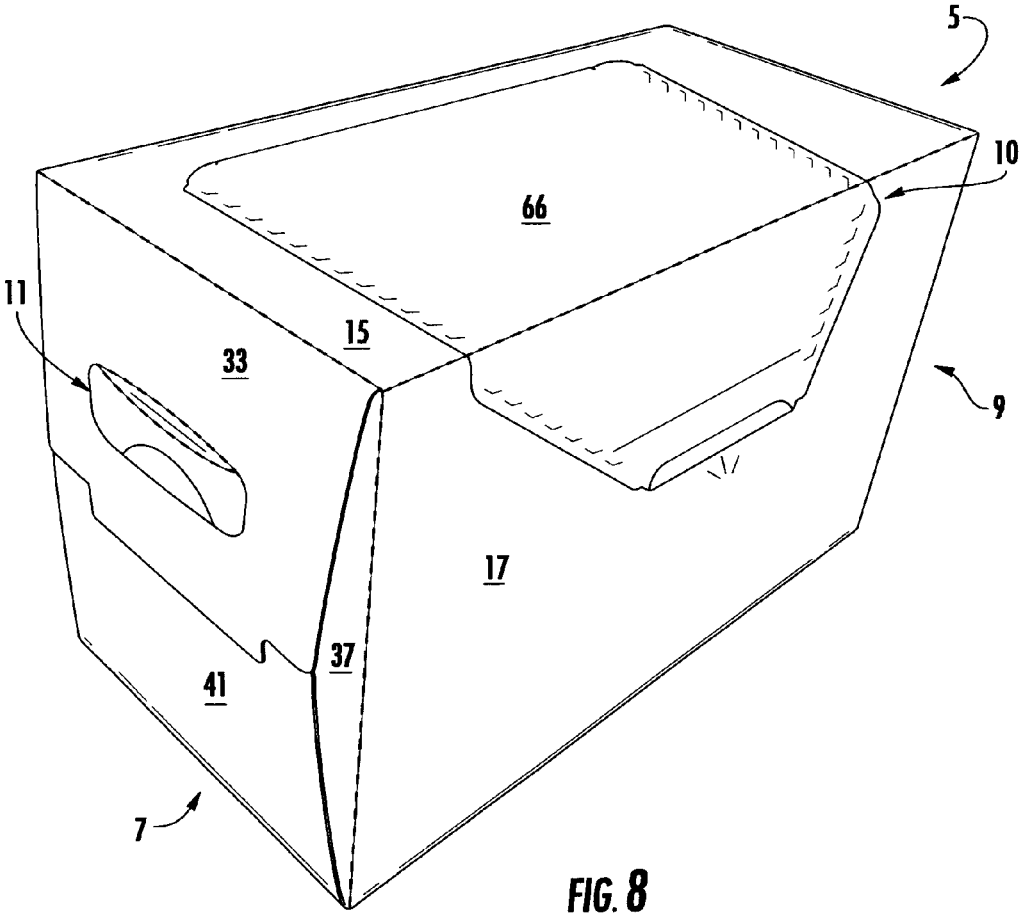
FIG. 8 is a perspective view of the erected carton according to the exemplary embodiment of the disclosure.

The erected carton 5 according to the exemplary embodiment is shown in FIG. 8. In the exemplary embodiment, the crown retention panel 137, the inner side flap 133, the crown guard flaps 181, 183, and/or other crown guard features can cooperate and can help provide an upper portion or crown area or crown feature of the carton 5 that is smaller than the lower portion of the carton to help restrain the narrower upper portions N of the containers C.

In the illustrated embodiment, a user can grasp and carry the carton 5 at the handles 11 by folding the outer handle flaps 49 and the inner handle flaps 119 into the interior 172 of the carton to form handle openings (not shown) in the ends 7, 9 of the carton. The dispenser 10 can be can be opened by tearing the dispenser panel 66 away along the tear lines 67 to form a dispenser opening (not shown) in the top panel 15 and the side panel 17 of the carton 5. The tearing of the dispenser panel can be initiated, for example, at the access panel 69. In one embodiment, the dispenser portion 159 of the central panel 107 of the insert 12 defined between the tear lines 161 can be glued to the portion of the dispenser panel 66 in the top panel 15. Accordingly, when the dispenser panel 66 is torn away, the central panel 107 can tear along the tear lines 161 and can fold along the fold line 163. Additionally, the crown retention panel 137, which can be attached to the dispenser panel 66 via the attachment flaps 145, can be pulled out of the interior of the carton as the dispenser panel 66 is pivoted upwardly along the fold line 68 to help provide access to the containers C. The handles 11 and/or the dispenser panel 10 could be otherwise actuated without departing from the disclosure.

In an alternative embodiment, the fold line 193 can be omitted in one or more of the crown guard flaps 181, 183 so that substantially all of the respective crown guard flap extends obliquely from the respective fold line 185 to the respective distal edge 198 in the alternative closed carton. In this alternative embodiment, the collapsing nicks 199 can be configured to help retain the distal edge 198 against, adjacent, and/or proximate to the top panel 15 as the top end flap 33, 35 and inner end flap 109, 111 are folded downwardly and the respective crown guard flaps fold with respect to the inner end flaps to extend obliquely from the closed ends to the top panel 15 and to contact the containers C adjacent the closed ends. The crown guard flaps and other features of the carton could be otherwise shaped, arranged, positioned, and/or configured without departing from the disclosure.

Any of the features of the various embodiments of the disclosure can be combined with, replaced by, or otherwise configured with other features of other embodiments of the disclosure (and/or the disclosures that have been incorporated by reference) without departing from the scope of this disclosure. Further, it is noted that the inserts, insert blanks, and/or crown retention features of the various embodiments can be incorporated into a carton having any carton style or panel configuration. The carton styles and panel configurations described above are included by way of example.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprises:

a plurality of panels extending at least partially around an interior of the carton, the plurality of panels comprising a top panel;

an insert comprising a central panel, an inner end flap foldably connected to the central panel, and at least one crown guard flap foldably connected to the inner end flap adjacent a crown guard relief in the insert, the crown guard flap being connected to at least a portion of the central panel by a collapsing nick, and the at least one crown guard flap comprising a first portion foldably connected to the inner end flap and a second portion foldably connected to the first portion; and a plurality of end flaps respectively foldably connected to respective panels of the plurality of panels, the plurality of end flaps being at least partially overlapped with respect to one another to thereby at least partially form a closed end of the carton, the plurality of end flaps comprising a top end flap foldably connected to the top panel and at least partially overlapping the inner end flap and being in face-to-face contact with the inner end flap;

wherein the top panel at least partially overlaps the central panel, and the crown guard flap is positioned for contact with at least one container of the plurality of containers with the collapsing nick being at least partially folded, and the first portion of the crown guard flap extends obliquely with respect to the inner end flap and the central panel, and the second portion of the crown guard flap is disposed adjacent the central panel.

2. The carton of claim 1, wherein the central panel comprises a stop edge extending along the crown guard relief, and a distal edge of the crown guard flap is disposed adjacent the stop edge.

3. The carton of claim 2, wherein the collapsing nick extends from the central panel adjacent the stop edge and extends from the crown guard flap adjacent the distal edge.

4. The carton of claim 2, wherein the crown guard flap comprises the first portion foldably connected to the inner end flap and the second portion foldably connected to the first portion, and the second portion of the crown guard flap is disposed adjacent the stop edge of the central panel.

5. The carton of claim 4, wherein the collapsing nick extends from the central panel adjacent the stop edge and from the second portion of the crown guard flap.

6. The carton of claim 1, wherein the collapsing nick is continuous with the central panel adjacent the crown guard relief and is continuous with the crown guard flap adjacent the crown guard relief.

7. The carton of claim 1, wherein the collapsing nick is a first collapsing nick, and the crown guard flap is further connected to the central panel by a second collapsing nick.

8. The carton of claim 1, wherein at least a portion of the second portion of the crown guard flap is for being disposed between a top portion of the at least one container and the top panel.

9. The carton of claim 1, wherein the second portion of the crown guard flap is at least partially in face-to-face contact with the top panel.

10. The carton of claim 1, wherein the inner end flap is foldably connected to the central panel along a first fold line, the first portion of the crown guard flap is foldably connected to the inner end flap along a second fold line, the second portion of the crown guard flap is foldably connected to the first portion of the crown guard flap along a third fold line, and each of the second fold line and the third fold line is spaced apart from the first fold line.

11. A carton for holding a plurality of containers, the carton comprises:

a plurality of panels extending at least partially around an interior of the carton, the plurality of panels comprising a top panel; and an insert comprising a central panel, an inner end flap foldably connected to the central panel, and at least one crown guard flap foldably connected to the inner end flap adjacent a crown guard relief in the insert, the crown guard flap being connected to at least a portion of the central panel by a collapsing nick;

wherein the top panel at least partially overlaps the central panel, the crown guard flap is positioned for contact with at least one container of the plurality of containers with the collapsing nick being at least partially folded, the inner end flap is foldably connected to the central panel along a first fold line, the first fold line is interrupted by the crown guard relief, the crown guard flap is foldably connected to the inner end flap along a second fold line, and the second fold line is spaced apart from the first fold line and the central panel.

12. The carton of claim 1, wherein at least a portion of the crown guard flap extends obliquely with respect to the inner end flap and the central panel.

13. The carton of claim 1, wherein the crown guard flap is a first crown guard flap, the crown guard relief is a first crown guard relief, and the insert comprises a second crown guard flap foldably connected to the inner end flap adjacent a second crown guard relief.

14. The carton of claim 13, wherein the collapsing nick is a first collapsing nick, and the second crown guard flap is connected to at least a portion of the central panel along a second collapsing nick.

15. The carton of claim 14, wherein the first crown guard flap is further connected to the central panel by a third collapsing nick, and the second crown guard flap is further connected to the central panel by a fourth collapsing nick.

16. The carton of claim 13, wherein the first crown guard flap comprises a first proximal portion foldably connected to the inner end flap and a first distal portion foldably connected to the first proximal portion, and the second crown guard flap comprises a second proximal portion foldably connected to the inner end flap and a second distal portion foldably connected to the second proximal portion.

17. The carton of claim 1, further comprising a handle formed in the closed end, the handle extending in at least the top end flap and the inner end flap.

18. The carton of claim 1, wherein the insert further comprises a crown retention panel foldably connected to the central panel and an attachment flap foldably connected to the crown retention panel.

19. The carton of claim 18, wherein the plurality of panels further comprises a side panel, at least a portion of the crown retention panel is spaced apart from the side panel in the interior of the carton for contacting at least one of the plurality of containers, and at least a portion of the attachment flap is at least partially in face-to-face contact with the side panel.

20. The carton of claim 19, wherein the side panel is a first side panel, the carton further comprises a second side panel, and the insert further comprises a side flap foldably connected to the central panel along a lateral fold line, the side flap extending at least generally downwardly from the central panel and towards the second side panel in the interior of the carton.

21. A carton for holding a plurality of containers, the carton comprises:

a plurality of panels extending at least partially around an interior of the carton, the plurality of panels comprising a top panel; and an insert comprising a central panel, an inner end flap foldably connected to the central panel, and at least one crown guard flap foldably connected to the inner end flap adjacent a crown guard relief in the insert, the crown guard flap being connected to at least a portion of the central panel by a collapsing nick;

wherein the top panel at least partially overlaps the central panel, and the crown guard flap is positioned for contact with at least one container of the plurality of containers with the collapsing nick being at least partially folded, and wherein the inner end flap is a first inner end flap, the crown guard flap is a first crown guard flap, the crown guard relief is a first crown guard relief, and the insert further comprises a second inner end flap foldably connected to the central panel opposite to the first inner end flap and a second crown guard flap foldably connected to the second inner end flap adjacent a second crown guard relief.

22. The carton of claim 21, wherein the collapsing nick is a first collapsing nick, and the second crown guard flap is connected to the central panel by a second collapsing nick.

23. In combination, a carton blank and an insert blank for forming a carton for holding a plurality of containers:

the carton blank comprising a plurality of panels comprising a top panel and the carton blank further comprising a plurality of end flaps respectively foldably connected to respective panels of the plurality of panels, the plurality of end flaps for being at least partially overlapped with respect to one another to thereby at least partially form a closed end of the carton when the carton is formed from the blank, and the insert blank comprising a central panel, an inner end flap foldably connected to the central panel, and at least one crown guard flap foldably connected to the inner end flap adjacent a crown guard relief in the insert, the crown guard flap being connected to at least a portion of the central panel by a collapsing nick and the plurality of end flaps comprising a top end flap foldably connected to the top panel and at least partially overlapping the inner end flap and being in face-to-face contact with the inner end flap;

wherein the top panel at least partially overlaps the central panel, and the crown guard flap is for being positioned to contact at least one container of the plurality of containers with the collapsing nick being at least partially folded when the carton is formed from the blank, and the combination further comprising handle features for forming a handle when the carton is formed from the blank, the handle features extending in at least the top end flap and the inner end flap.

24. The combination of claim 23, wherein the central panel comprises a stop edge extending along the crown guard relief, and a distal edge of the crown guard flap is for being disposed adjacent the stop edge when the carton is formed from the blank.

25. The combination of claim 24, wherein the collapsing nick extends from the central panel adjacent the stop edge and extends from the crown guard flap adjacent the distal edge.

26. The combination of claim 24, wherein the crown guard flap comprises a first portion foldably connected to the inner end flap and a second portion foldably connected to the first portion, and the second portion of the crown guard flap is for being disposed adjacent the stop edge of the central panel when the carton is formed from the blank.

27. The combination of claim 26, wherein the collapsing nick extends from the central panel adjacent the stop edge and from the second portion of the crown guard flap.

28. The combination of claim 23, wherein the collapsing nick is continuous with the central panel adjacent the crown guard relief and is continuous with the crown guard flap adjacent the crown guard relief.

29. The combination of claim 23, wherein the collapsing nick is a first collapsing nick, and the crown guard flap is further connected to the central panel by a second collapsing nick.

30. The combination of claim 23, wherein the crown guard flap comprises a first portion foldably connected to the inner end flap and a second portion foldably connected to the first portion.

31. The combination of claim 30, wherein at least the second portion of the crown guard flap is at least partially in face-to-face contact with the top panel.

32. The combination of claim 30, wherein the inner end flap is foldably connected to the central panel along a first fold line, the first portion of the crown guard flap is foldably connected to the inner end flap along a second fold line, the second portion of the crown guard flap is foldably connected to the first portion of the crown guard flap along a third fold line, and each of the second fold line and the third fold line is spaced apart from the first fold line.

33. In combination, a carton blank and an insert blank for forming a carton for holding a plurality of containers:

the carton blank comprising a plurality of panels comprising a top panel; and the insert blank comprising a central panel, an inner end flap foldably connected to the central panel, and at least one crown guard flap foldably connected to the inner end flap adjacent a crown guard relief in the insert, the crown guard flap being connected to at least a portion of the central panel by a collapsing nick;

wherein the top panel at least partially overlaps the central panel, and the crown guard flap is for being positioned to contact at least one container of the plurality of containers with the collapsing nick being at least partially folded when the carton is formed from the blank, and wherein the inner end flap is foldably connected to the central panel along a first fold line, the first fold line is interrupted by at least one of the crown guard flap and the crown guard relief, the crown guard flap is foldably connected to the inner end flap along a second fold line, and the second fold line is spaced apart from the first fold line and the central panel.

34. The combination of claim 23, wherein the crown guard flap is a first crown guard flap, the crown guard relief is a first crown guard relief, and the insert comprises a second crown guard flap foldably connected to the inner end flap adjacent a second crown guard relief.

35. The combination of claim 34, wherein the collapsing nick is a first collapsing nick, and the second crown guard flap is connected to at least a portion of the central panel along a second collapsing nick.

36. The combination of claim 35, wherein the first crown guard flap is further connected to the central panel by a third collapsing nick, and the second crown guard flap is further connected to the central panel by a fourth collapsing nick.

37. The combination of claim 34, wherein the first crown guard flap comprises a first proximal portion foldably connected to the inner end flap and a first distal portion foldably connected to the first proximal portion, and the second crown guard flap comprises a second proximal portion foldably connected to the inner end flap and a second distal portion foldably connected to the second proximal portion.

38. The combination of claim 23, wherein the insert further comprises a crown retention panel foldably connected to the central panel and an attachment flap foldably connected to the crown retention panel.

39. The combination of claim 38, wherein the crown retention panel is foldably connected to the central panel along a lateral fold line that is inwardly spaced from an outer edge of the insert blank, and the insert further comprises a side flap foldably connected to the central panel along a lateral fold line, the side flap being spaced apart from the crown retention panel.

40. In combination, a carton blank and an insert blank for forming a carton for holding a plurality of containers:

the carton blank comprising a plurality of panels comprising a top panel; and the insert blank comprising a central panel, an inner end flap foldably connected to the central panel, and at least one crown guard flap foldably connected to the inner end flap adjacent a crown guard relief in the insert, the crown guard flap being connected to at least a portion of the central panel by a collapsing nick;

wherein the top panel at least partially overlaps the central panel, and the crown guard flap is for being positioned to contact at least one container of the plurality of containers with the collapsing nick being at least partially folded when the carton is formed from the blank; and wherein the inner end flap is a first inner end flap, the crown guard flap is a first crown guard flap, the crown guard relief is a first crown guard relief, and the insert further comprises a second inner end flap foldably connected to the central panel opposite to the first inner end flap and a second crown guard flap foldably connected to the second inner end flap adjacent a second crown guard relief.

41. The combination of claim 40, wherein the collapsing nick is a first collapsing nick, and the second crown guard flap is connected to the central panel by a second collapsing nick.

42. A method of forming a carton for holding a plurality of containers, the method comprising:

obtaining a carton blank comprising a plurality of panels comprising a top panel and the carton blank further comprising a plurality of end flaps respectively foldably connected to respective panels of the plurality of panels, the plurality of end flaps comprising a top end flap foldably connected to the top panel;

obtaining an insert blank comprising a central panel, an inner end flap foldably connected to the central panel, and at least one crown guard flap foldably connected to the inner end flap adjacent a crown guard relief in the insert, the crown guard flap being connected to at least a portion of the central panel by a collapsing nick and the at least one crown guard flap comprising a first portion foldably connected to the inner end flap and a second portion foldably connected to the first portion;

positioning the insert blank relative to the carton blank so that the top panel at least partially overlaps the central panel and the top end flap at least partially overlaps the inner end flap and is in face-to-face contact with the inner end flap;

forming an interior of the carton at least partially defined by the plurality of panels, the forming the interior of the carton comprising forming an open-ended sleeve;

forming a crown retention feature in the interior of the carton comprising folding the inner end flap over an end of the open-ended sleeve, the folding the inner end flap causing at least a portion of the crown guard flap to fold with respect to the inner end flap for contacting at least one container of the plurality of containers, the folding of the crown guard flap causing the first portion of the crown guard flap to extend obliquely with respect to the inner end flap and the central panel, and the collapsing nick to be at least partially folded; and forming a closed end of the carton by at least partially overlapping the plurality of end flaps with respect to one another, wherein the first portion of the crown guard flap extends obliquely with respect to the inner end flap and the central panel, and the second portion of the crown guard flap is disposed adjacent the central panel.

43. The method of claim 42, wherein the folding the inner end flap causes at least a portion of the crown guard flap to move toward a stop edge of the central panel and at least a portion of the crown guard flap to extend obliquely from the inner end flap toward the top panel.

44. The method of claim 42, wherein the collapsing nick at least partially retains at least a portion of the crown guard flap against the top panel as the crown guard flap folds with respect to the inner end flap.

45. The method of claim 42, further comprising loading the plurality of containers into the interior of the carton after the forming the interior of the carton, wherein the folding the inner end flap causes at least a portion of the crown guard flap to move toward a stop edge of the central panel to be disposed at least partially between the top panel and a top portion of at least one container of the plurality of containers.

46. The method of claim 42, wherein the collapsing nick is connected to at least the second portion, the forming the crown retention feature further comprising positioning the second portion to be disposed at least partially between the top panel and a top portion of at least one container of the plurality of containers and positioning the first portion to extend obliquely from the inner end flap to the top panel.

47. The method of claim 42, wherein:

the plurality of panels further comprises a side panel;

the insert blank further comprises a crown retention panel foldably connected to the central panel and an attachment flap foldably connected to the crown retention panel; and the forming the crown retention feature further comprises attaching at least a portion of the attachment flap in face-to-face contact with the side panel, and positioning the crown retention panel to extend generally downwardly from the top panel and the central panel so that the crown retention panel is spaced apart from the side panel.

* * * * *